US005305789A

United States Patent [19]

Rivolier

[11] Patent Number: 5,305,789

[45] Date of Patent: Apr. 26, 1994

[54] HYDRAULIC DIRECTIONAL CONTROL VALVE COMBINING PRESSURE COMPENSATION AND MAXIMUM PRESSURE SELECTION FOR CONTROLLING A FEED PUMP, AND MULTIPLE HYDRAULIC CONTROL APPARATUS INCLUDING A PLURALITY OF SUCH VALVES

[75] Inventor: Michel Rivolier, L'Arbresle, France

[73] Assignee: Rexroth-Sigma, France

[21] Appl. No.: 44,531

[22] Filed: Apr. 6, 1993

[30] Foreign Application Priority Data

Apr. 6, 1992 [FR] France ..... 92-04183

[51] Int. Cl.[5] ..... F15B 13/08

[52] U.S. Cl. ..... 137/596; 60/427; 60/452; 91/446; 91/518; 137/596.13

[58] Field of Search ..... 60/427, 452; 91/446, 91/518; 137/596, 596.13

[56] References Cited

U.S. PATENT DOCUMENTS

| | | |
|---|---|---|
| 3,465,519 | 9/1969 | McAlvay et al. . |
| 3,534,774 | 10/1970 | Tennis . |
| 3,827,453 | 8/1974 | Malott et al. . |
| 4,361,169 | 11/1982 | Williams . |
| 4,436,114 | 3/1984 | Kotter . |
| 4,574,839 | 3/1986 | Yeh et al. . |
| 4,688,600 | 8/1987 | Kreth et al. . |
| 4,693,272 | 9/1987 | Wilke . |
| 4,719,753 | 1/1988 | Kropp . |
| 4,787,294 | 11/1988 | Bowden . |
| 5,025,625 | 6/1991 | Morikawa . |
| 5,067,389 | 11/1991 | St. Germain . |
| 5,138,837 | 8/1992 | Obertrifter et al. . |
| 5,146,747 | 9/1992 | Sugiyama et al. . |

FOREIGN PATENT DOCUMENTS

| | | |
|---|---|---|
| 0197314 | 10/1986 | European Pat. Off. . |
| 0491050 | 6/1992 | European Pat. Off. . |
| 1452609 | 10/1976 | United Kingdom . |
| 1467603 | 3/1977 | United Kingdom . |
| 1516224 | 6/1978 | United Kingdom . |
| 79/00907 | 11/1979 | World Int. Prop. O. . |
| 92/01163 | 1/1992 | World Int. Prop. O. . |

*Primary Examiner*—Gerald A. Michalsky
*Attorney, Agent, or Firm*—Larson and Taylor

[57] ABSTRACT

A pressure compensating hydraulic directional valve comprising: a body provided with a movable slide; a passage through the body for connecting a distribution chamber associated with the slide to working orifices, the distribution chamber being selectively connectable to an admission orifice by the slide when moved; a load sensing line channel combined with means for selecting the maximum pressure selected from the pressure in the channel and the pressure of the fluid in the valve; and pressure compensating means placed in the passage and responsive to the difference between the pressure in the passage and the pressure in the channel to generate a fixed pressure drop in the pressurized fluid flowing through the passage towards the working orifices, the pressure compensating means being combined with the maximum pressure selecting means in such a manner that if the pressure in the channel is greater than or equal to the pressure of the fluid from the slide, then no communication exists between the passage and the channel and the pressure in the channel retains its value, or else, if the pressure in the channel is less than the pressure of the fluid from the slide, communication is established between the passage and the channel, and the pressure in the channel becomes the same as the pressure of the pressurized fluid.

14 Claims, 8 Drawing Sheets

HYDRAULIC DIRECTIONAL CONTROL VALVE COMBINING PRESSURE COMPENSATION AND MAXIMUM PRESSURE SELECTION FOR CONTROLLING A FEED PUMP, AND MULTIPLE HYDRAULIC CONTROL APPARATUS INCLUDING A PLURALITY OF SUCH VALVES

FIELD OF THE INVENTION

The present invention relates to improvements applied to hydraulic directional control valves that combine pressure compensation with maximum pressure selection for controlling a feed pump (a so-called "load sensing" system), and more particularly it relates to improvements applied to a pressure-compensating hydraulic directional control valve comprising:

a valve body;

a slide received in the body to be capable of being displaced longitudinally therein for selectively transmitting a pressurized hydraulic fluid to working orifices provided in the body from an orifice for admitting pressurized hydraulic fluid;

a passage in said body for connecting a distribution chamber to the working orifices, the distribution chamber being associated with the slide and being suitable for being connected selectively to the admission orifice by the displaced slide;

a load sensing line channel combined with maximum pressure selecting means organized to establish in said channel the maximum pressure selected from the pressure existing in said channel and the pressure of the pressurized fluid of the valve; and pressure compensating means placed in said passage and responsive to the difference between the pressure of the fluid in the valve and the pressure existing in said channel in order to generate a substantially fixed pressure drop in the pressurized fluid flowing towards the working orifices.

BACKGROUND OF THE INVENTION

It is briefly recalled that in a set of valves controlling respective loads that require different hydraulic powers, the load sensing system consists in detecting which one of the loads requires the maximum power and thus the maximum pressure in the working hydraulic fluid fed thereto, and in applying said maximum pressure to a control inlet of the pump so as to servo-control the pump to requirements. This function is implemented by providing each control valve with a selector that is responsive on one side to the pressure of the working fluid delivered to the load controlled by the valve and on its opposite side to the pressure of the working fluid delivered to another load controlled by a control valve and which is suitable for selecting the higher of said two pressures. By performing stepwise selection, it is the maximum pressure of the entire hydraulic system that finally controls the pump.

Installing the means (selectors and link channels) required for implementing a load sensing system within the control valves gives rise to a control valve structure that is quite complex. Various simplifications have been found for certain types of control valve, but none has yet been found for directional control valves that operate proportionally.

In addition, the load sensing lines are conventionally fed from a pressure take-off point formed at the load. When hydraulic fluid is first delivered, the load sensing line is fed with fluid before the load itself is. If the sensing line has a leak (and such a leak may be provided deliberately in certain modes of operating hydraulic circuits), the control pressure applied to the load begins by decreasing before it increases to the nominal value imposed by the control valve. As a result, the load (e.g. a hinged arm) begins by moving down before it moves up in compliance with the control applied thereto, and in any event a jolt occurs at the instant at which normal conditions are re-established. That constitutes a real drawback of the system which may turn out to be dangerous.

Furthermore, in a conventional hydraulic directional control valve, the hydraulic fluid flow rate delivered by the working orifice of the valve is subjected to fluctuations as a function of the magnitude of the flow rate as determined by the position of the slide and as a function of the pressure delivered by the pump. It is known that this drawback can be mitigated and the working fluid flow rate can be made constant regardless of circumstances (e.g. from U.S. Pat. No. 3,827,453) by providing pressure compensating means in the control valve that continuously compare the working pressure from the pump with a reference value that may be fixed or variable. If variable, it may be constituted by the maximum pressure as selected in the load sensing line, so as to throttle the working fluid accordingly, thereby establishing a constant pressure drop in said working fluid.

In known control valves (e.g. U.S. Pat. No. 4,693,272), the presence of such pressure compensating means further increases the complexity of the structure since although said pressure compensating means use the maximum pressure information present in the load sensing line, they are established independently of the means used for selecting the maximum pressure.

In addition, using such pressure compensation requires, in particular, a fraction of the necessary hydraulic links to pass through the slide. Drilling the corresponding ducts in the slide considerably increases the cost of manufacturing it. Furthermore, the presence of such ducts drilled through the slide occupies the internal volume thereof and it is no longer possible to provide other drillings that may be useful for other purposes, e.g. those required for implementing a load braking system. Such other systems then need to be designed in the form of circuits including external pipework, thereby further increasing complexity and expense of the assembly as a whole.

In other known directional control valves (U.S. Pat. No. 5,138,837, EP 0 438 606), attempts at simplifying and integrating the pressure compensating means and the load sensing means can indeed be found. However, the load sensing means continue to be implemented with a pressure take-off point situated in the line connected to the load: such known control valves therefore continue to suffer from the drawbacks mentioned above for that kind of organization.

It may also be added that in known directional control valves in which the pressure compensating function is provided by a spring-biased non-return valve, the pump-controlling pressure differs from the pressure of the pressurized fluid delivered by the pump not only by the pressure drop imposed by the pressure compensating means, but also by the head loss which is introduced by the non-return function provided by the non-return valve in the most heavily loaded control valve, corresponding to the rated value of the spring biasing the non-return valve. Thus, with such an organization, the presence of the return spring disturbs the ideal operation of the system, and this turns out to be a considerable drawback which makes itself felt most particularly in very low pressure ranges.

OBJECT AND SUMMARY OF THE INVENTION

An essential object of the invention is thus to remedy the drawbacks presented by present hydraulic directional control valves of the type having pressure compensation and maximum pressure selection, and to propose an improved valve which gives greater satisfaction to various practical requirements, and which in particular is simpler in design and in structure, and is thus cheaper, while nevertheless retaining the same sensitivity in operation over the entire pressure range, including very low pressures, and, above all, which is organized in such a way that the control of the variable flow rate pump that feeds the control valve is provided in a manner that is highly effective and independent of reactions from the load.

For these purposes, the invention provides a directional control valve including pressure compensation of the type specified in the preamble, wherein the pressure compensating means are combined with the maximum pressure selecting means;

and wherein selective link means exist that are suitable for selectively establishing a link between the channel and the passage upstream from the pressure compensating means in such a manner that:

if the pressure in the channel is greater than or equal to the pressure of the fluid in the passage upstream from the pressure compensating means, no communication exists between said passage and said channel, and the pressure in the channel retains its value; or else if the pressure in the channel is less than the pressure of the fluid in the passage upstream from the pressure compensating means, communication is established between said passage upstream from the pressure compensating means and said channel, and the pressure in the channel becomes the same as the pressure of the fluid present in the passage upstream from the pressure compensating means.

The dispositions of the invention make it possible to combine and mutually integrate the pressure compensating means and the maximum pressure selecting means, thereby leading to considerable simplification of the internal structure of the valve by eliminating special channels and by eliminating the special selector that has hitherto been provided for constituting the maximum pressure selection means and for performing said selection function. With the invention there is only one single channel passing directly through the body of the valve (e.g. cross-wise), level with one of the ends of the pressure compensating means. Since the pressure selecting means may also be implemented in a form that is structurally very simple, as can be seen below, it will be understood that the improvement provided by the invention is highly advantageous both in manufacture (much less machining in the valve body and fewer component parts, therefore greatly reduced manufacturing cost), and in use and during maintenance (fewer possible sources of faulty operation, less maintenance).

Above all, the organization of the invention greatly improves the operational reliability of the hydraulic system built around the control valve. It is shown above that the valve is organized in such a way that when the pressure in the valve is greater than the pressure in the channel of the load sensing line, communication is established directly between the channel and the passage transmitting pressurized fluid. As a result the pressure that exists in said channel is the pressure of the fluid coming from the pump and any leak in the line connected to said channel does not have the above-mentioned unfavorable effect that exists in present devices.

Preferably, in a structurally simple embodiment, the pressure compensating means combined with the maximum pressure selecting means comprise:

a bore provided in the body and connected at one end to said passage coming from the chamber controlled by the slide and at its other end to said load sensing line channel;

a moving control plunger free to slide in said bore under drive from the pressures acting on opposite ends thereof;

first shutter means disposed in said pressurized fluid passage and secured to said plunger; and second shutter means disposed in a connection between said pressurized fluid passage and said channel, and secured to said plunger, said plunger being suitable for occupying:

a first end position or "doubly-closed" position which it occupies in the absence of pressurized fluid, and in which the first and second shutter means are closed;

a set of intermediate positions occupied when the pressurized fluid is present in the passage, the position of the plunger being determined by the difference between the pressure in the passage and the pressure in the channel when the pressure in the channel is greater than the pressure in the passage, in which the second shutter means are kept closed and the first shutter means are opened to an extent suitable for causing a predetermined pressure drop in the flow of pressurized fluid; and a second extreme position or "doubly-open" position which is occupied when the pressure of the fluid in the passage is greater than the pressure in the channel, in which the first shutter means are fully open and the second shutter means are also open, thereby establishing communication between said passage and said channel.

In a particular embodiment, it is advantageous that:

the portion of said passage connected to the chamber controlled by the slide communicates with one end of the bore;

the portion of said passage connected to the working orifices opens radially into the bore; and said first shutter means are constituted by said plunger implemented in elongate form so that:

in its first stream position, it fully closes said opening of the passage;

in its set of intermediate positions, it partially closes said opening to create the predetermined pressure drop; and in its second extreme position it completely disengages said opening.

In which case, said second shutter means may be constituted by said plunger and may be provided with an internal duct that opens out at one end into the face of the plunger which is subjected to the pressure of the fluid in the passage and that opens out at its other end radially into the vicinity of the other face of the plunger which is subjected to the pressure of the channel, whereby:

when the plunger is in its first extreme position and in its set of intermediate positions, the radial outlet of said duct is closed by the bore; and when the plunger is in its second extreme position, the radial outlet of said duct has moved out from the bore and is in communication with said channel.

In a simple embodiment, the combined pressure compensating means and maximum pressure selecting means are unique and are selectively connectable to one of the two working orifices.

However, it is also possible, at least in certain special applications for which the above disposition cannot be used and which require total independence between the two hydraulic paths leading to the two working orifices of the valve, respectively, for the combined pressure compensating means and maximum pressure selecting means to be two-fold, each associated with a respective one of the two working orifices.

To escape from the influence of excess pressure in the working orifice, it is possible to provide a non-return valve in said passage, between the pressure compensation means and each of the working orifices. Depending on requirements and on the structure adopted, it is then possible to provide a single non-return valve in the above-specified passage, between the pressure compensating means and one of the working orifices, or else two non-return valves in the above-specified passage, between the pressure compensating means and each of the two working orifices, respectively.

It is desirable to return the plunger into a predetermined position when it is not subjected to any pressure, and to do this, provision is made for the pressure compensating means combined with the maximum pressure selecting means further to comprise resilient return means acting on the moving plunger to urge it in the same direction as the direction in which it is urged by the pressure that exists in the channel: in the absence of pressure, the plunger is thus held pressed by its head against a corresponding retaining shoulder.

Because of the means implemented by the invention, it is observed that all of the fluid links can be provided within a single valve body and that there is no need to provide some links through the slide as has been required, on the contrary, until now in prior art directional control valves. By omitting such special machining, it is possible to reduce the manufacturing costs of the slide or, at least, to make room available for fitting the slide with links provided for other purposes, in particular to provide additional functions that are not involved with selecting the maximum pressure and/or with pressure compensation.

The invention also provides a multiple hydraulic control apparatus interposed between a variable flow rate source of pressurized fluid and a return tank, on one side, and a plurality of hydraulic load members to be controlled respectively and selectively from said source. In a first possible embodiment, said apparatus comprises a side-by-side stack of:

a plurality of hydraulic directional control valves as defined above;

a terminal element; and an inlet element which is transparent for the lines through the stacked valves and connected respectively to the pressurized outlet from the source and to the return tank, which includes a flow rate regulator for the purpose of decompression at zero flow rate interposed between a control line for controlling the source by sensing the load from the stacked valves and the return line, and which includes a constriction interposed between the control line for controlling the source by sensing the load from the stacked valves and the control input of the source, said constriction being disposed to establish a smaller head loss across the terminals of the plunger in each of the valves; advantageously, in such a circuit, between the outlet of the second constriction and the return line, a circuit is provided for limiting the pump-controlling pressure by load sensing, which circuit is suitable for limiting said controlling pressure when the pump is delivering its maximum pressure.

In another possible embodiment, the apparatus comprises a side-by-side stack of:

a plurality of hydraulic directional control valves, each valve including a constriction interposed between the load sensing line channel and the distribution chamber, said constriction being made operative when communication is established between the passage and the channel and being disposed to establish head loss across the terminals of the plunger of the valve;

a terminal element; and an inlet element which is transparent for the lines through the stacked valves connected respectively to the pressurized outlet from the source and to the return tank, and which includes a flow rate regulator providing decompression at zero flow rate, interposed between a control line for controlling the source by sensing the load from the stacked valves and the return line.

BRIEF DESCRIPTION OF THE DRAWINGS

The invention will be better understood on reading the following detailed description of a preferred embodiment given purely by way of illustrative example. In the description, reference is made to the accompanying drawings, in which.

MORE DETAILED DESCRIPTION

Figure 1:
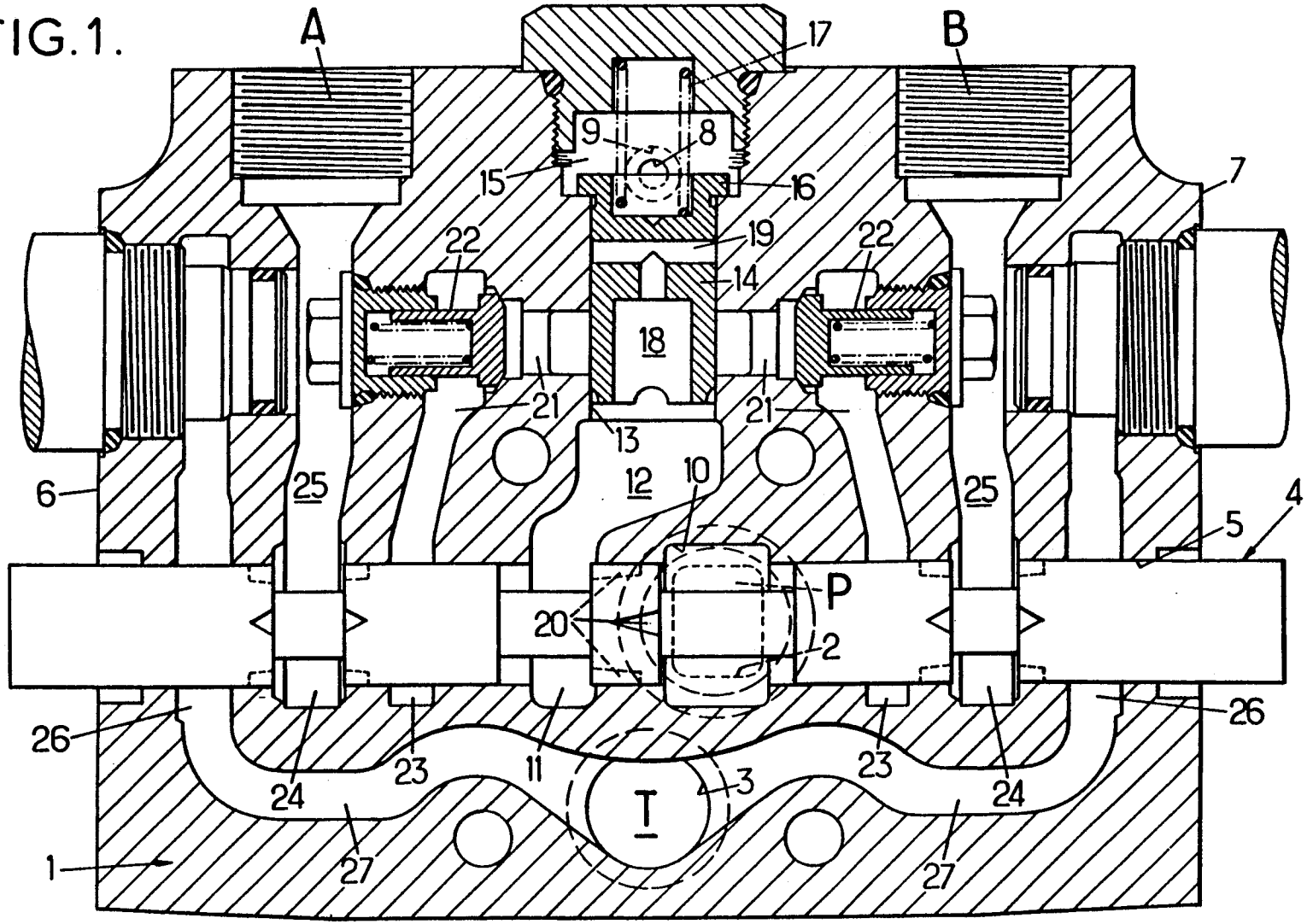
FIG. 1 is a section view through a hydraulic directional control valve implemented in accordance with the invention, the slide of said valve being shown in its neutral or inactive position.

With reference initially to FIG. 1, the directional control valve shown therein comprises a body 1 provided with an orifice P for admitting pressurized fluid (constituted by a channel 2 that passes through the body 1 transversely to the plane of the drawing and that opens out into the two main faces of said body that are used for support purposes when a plurality of valves are stacked side-by-side against one another), at least one orifice T for returning fluid to a tank (not shown), (said orifice being implemented in the form of a channel passing through the body 1 transversely to the plane of the drawing and opening out into both of the main faces of said body), two orifices A and B for connection to a hydraulic component or apparatus (not shown), and a slide 4 suitable for sliding in a bore 5 of the body 1. The bore 5 passes through the body 1 longitudinally and it opens out into two opposite end faces 6 and 7 thereof. In conventional manner, the body 1 and the slide 4 include passages and/or ducts and/or grooves organized in such a manner as to co-operate for the purpose of establishing the desired connections o interruptions between the various orifices in the valve body depending on the position occupied by the slide. The features of such passages and/or ducts and/or grooves that are specific to the invention are mentioned below.

The body 1 also includes another transverse channel 8 that extends between the main faces of the body and that is combined with at least one pressure selector that makes it possible to transmit into the channel 18 downstream from the valve the higher of two pressures constituted respectively by the pressure upstream from the valve and a working pressure of the valve (referred to as the "load sensing" pressure or the LS pressure). At each end, the channel 8 opens out into a cavity formed in the corresponding main face of the body (a cavity 9 is visible in FIG. 1). The cavities are positioned on the main faces in such a manner that when two valves are stacked face-to-face, the cavity 9 provided on a main face of one of them and the cavity provided on the co-operating main face of the other one of them co-operate to constitute a chamber in which a sealing ring (not shown) is housed, thereby enabling the channel 8 to pass all the way through a control block constituted by a stack of a plurality of valves, regardless of the number of such valves. The general principles on which such a maximum pressure selector operates are well known to the person skilled in the art and are not repeated herein.

The channel 2 connected to the admission orifice P opens out into the bore 5 of the body in an admission chamber 10 thereof, close to which another chamber 11 communicates via a passage 12 with a housing 13 in which a plunger 14 is mounted to slide freely in sealed manner. The passage 12 opens out into one end of the housing 13 (corresponding to an end face of the plunger 14) and the other end of the housing 13 opens out into a cavity 15 within which the head 16 of the plunger 14 is free to move. The head 16 is larger than the body of the plunger and bears against a plunger-retaining shoulder formed where the housing 13 opens out into the cavity 15. A spring 17 may be provided in the cavity 15 to urge the plunger 14 against said shoulder so as to fix the position thereof in the absence of any pressure. The above-mentioned channel 8 is in communication with the cavity 15 such that the pressure that exists in the channel 8 is also present in the cavity 15 and is thus applied to the corresponding end of the plunger 14.

In addition, the plunger 14 has an axial channel 18 passing therethrough, opening out at one end in the end face of the plunger looking into the passage 12, and at its other end into a diametrically-extending channel 19 that passes through the plunger 14 and that is located in such a manner as to be closed by the wall of the housing 13 when the plunger 14 is in its rest position as imparted by the spring 17 (as shown in FIG. 1), or when it is in a position where it is not fully raised, as explained below.

The portion of the slide 4 that, in the neutral position, extends between the chambers 10 and 11, and isolates them from each other, is provided with tapering notches 20 for providing controlled flow of hydraulic fluid in the appropriate direction when the slide is displaced in one direction or the other.

Two ducts 21 extend from the above-mentioned housing 13 in respective approximately diametrically opposite directions, for example, with each of the ducts 21 containing a non-return valve 22, should that be necessary, said ducts 21 opening out into the bore 5 via two respective chambers 23.

Figure 2:
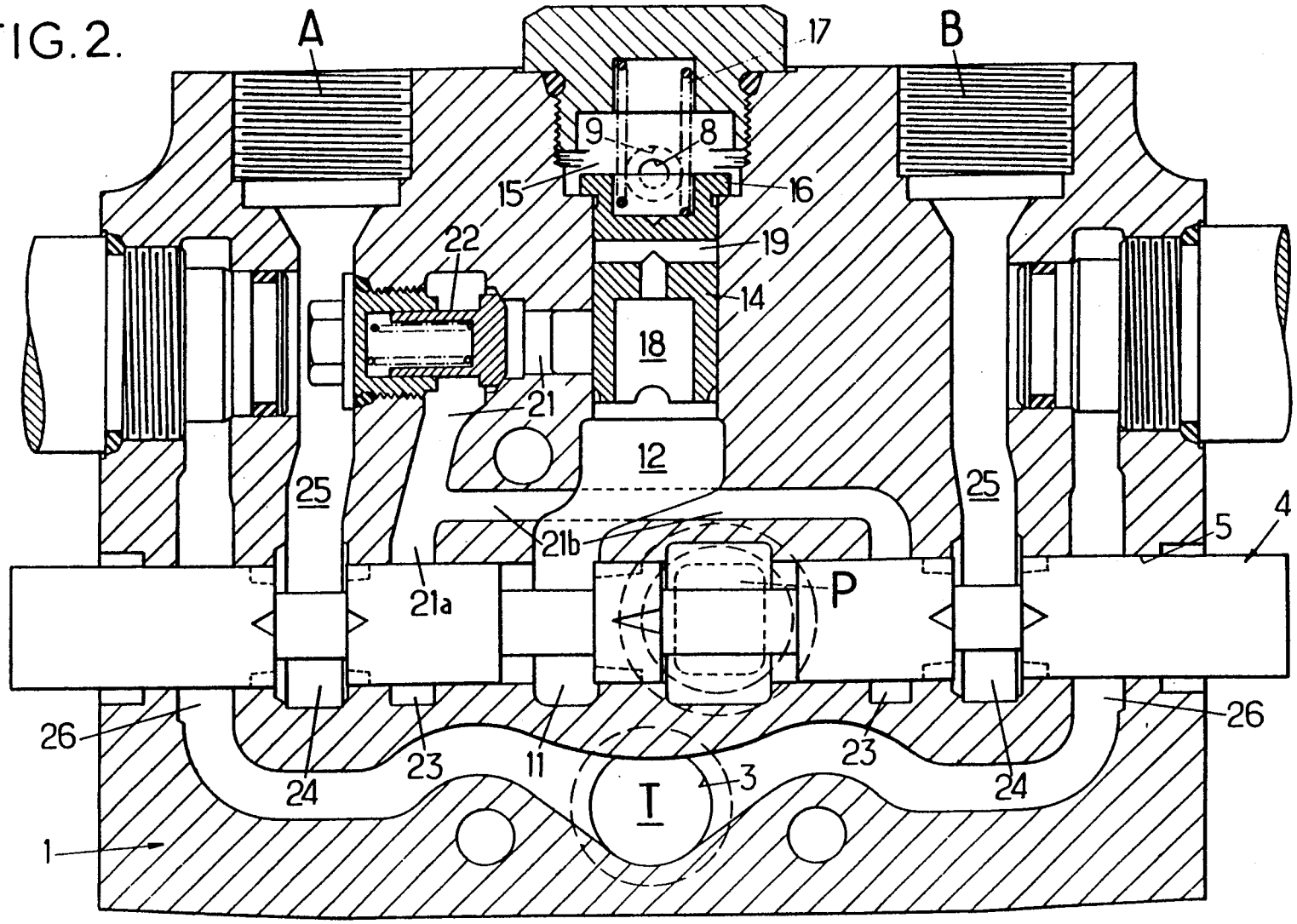
FIG. 2 is a section view through a variant embodiment of the FIG. 1 valve.

Naturally, other dispositions could be used in this context. By way of example. FIG. 2 shows a variant in which a single duct 21 is provided starting from the housing 13, using a single non-return valve 22, and extending beyond the non-return valve in two branches 21*a* and 21*b* that run into respective ones of the two chambers 23.

In the vicinity of the chambers 23, two respective manifold chambers 24 of the bore 5 are connected via ducts 25 to respective outlet or working orifices A and B.

Finally, beyond the manifold chambers 24, two respective return chambers 26 of the bore 5 are connected via ducts 27 to the return channel 3 that opens out into the return orifice T.

The above-described valve operates as follows.

For the purposes of this explanation, it is assumed that the valve is part of a multiple control block constituted by a face-to-face stack of a plurality of identical valves (an embodiment is described below), in which the orifices P, T, and 9 provided in the main faces of the valves communicate with one another. In particular, the channels 8 constitute a lie for transmitting the maximum pressure (the "load sensing" line or LS line) which is connected to a control inlet of a variable flow rate pump (not show n) whose pressurized outlet is connected to the orifices P.

When the slide 4 is in its neutral position as shown in FIG. 1, all of the chambers of the bore 5 are isolated from one another and no fluid flows between the orifices P, T, A, and B. The plunger 14 is then urged by the spring 17 so that its head comes into abutment, thereby closing the ducts 21, regardless of the pressures respectively obtaining in the passage 12 and in the cavity 15 (LS pressure).

Figure 3:
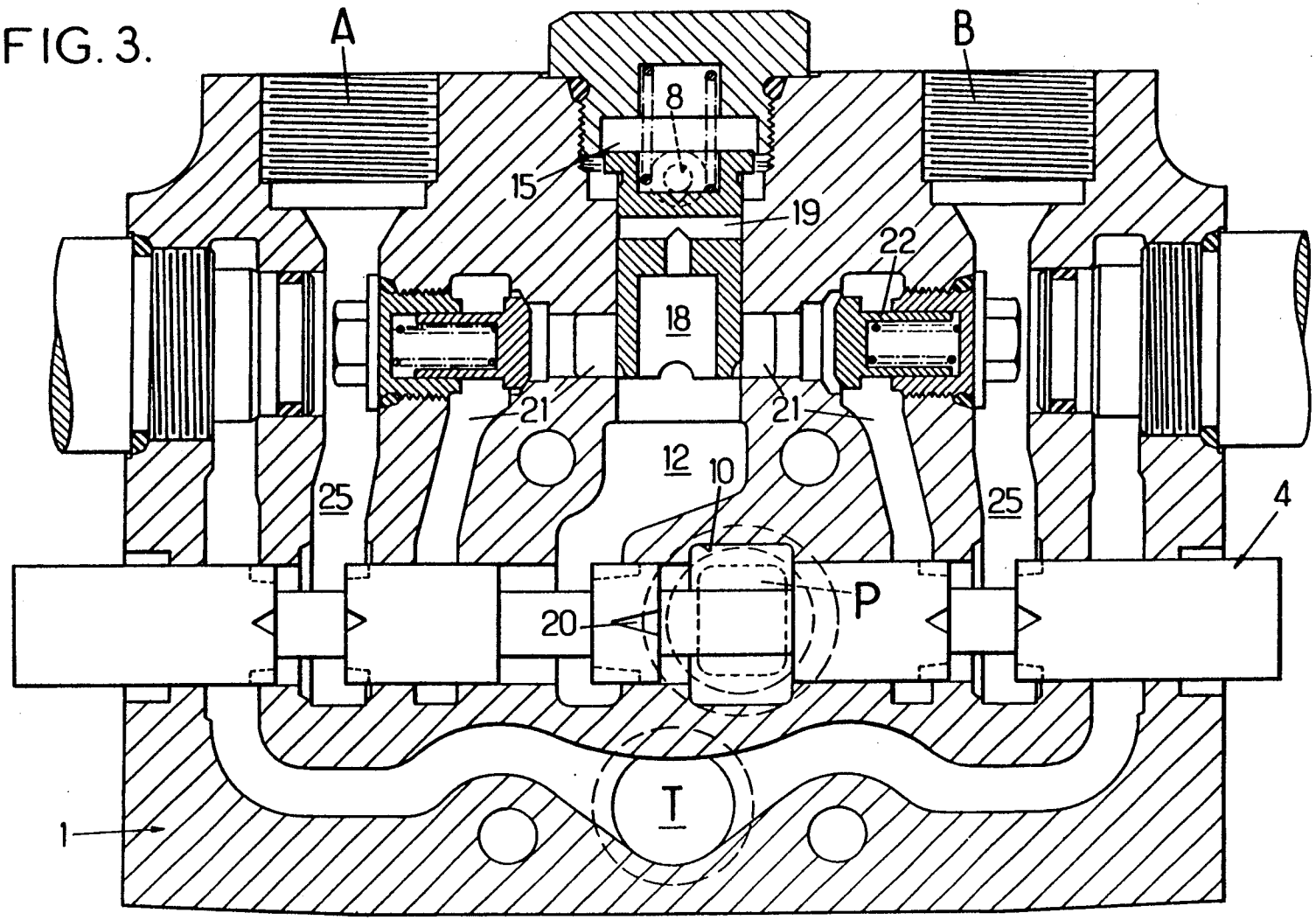
FIGS. 3 and 4 are section views through the FIG. 1 valve showing it respectively in two other different operating positions.
Figure 4:
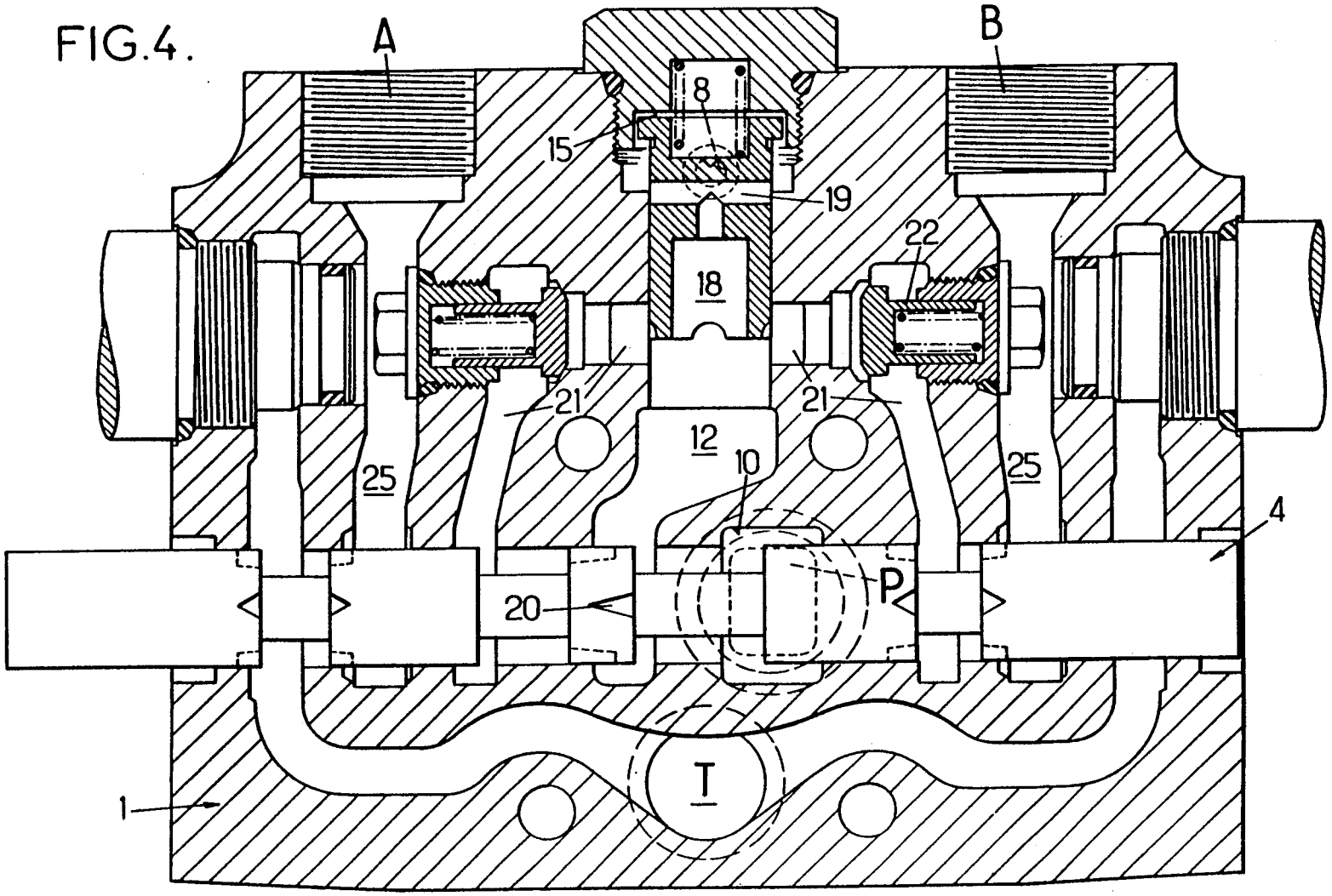

When the slide is displaced progressively (e.g. to the left, FIG. 3), hydraulic fluid from the orifice P flows, with an associated pressure drop, via the tapering notches 20 into the passage 12 in which the pressure increases progressively. So long as the force due to the pressure int he passage 12 and acting on the bottom face of the plunger 14 remains below the sum of the rated force from the spring 17 and the force due to the LS pressure in the cavity 15 which acts on the top face of the plunger 14, the plunger 14 stays int he same position. As soon as the pressure in the passage 12 becomes greater than the pressure on the other face of the plunger (rated force of the spring plus LS pressure), the plunger begins to move (upwards int he drawing) as shown in FIG. 3, so as to take up a new equilibrium position in which the pressure in the passage 12 is equal to the LS pressure plus the force due to the rating spring. The plunger then partially reveals the inlet to the duct 21 and fluid flows along this path and is subjected to a pressure drop that is constant regardless of the flow rate and that is regulated by the difference between the admission pressure, and the LS pressure. The non-return valve 22 (the valve situated on the right in FIG. 3, in the example under consideration) opens and the flow of fluid is conveyed towards the orifice B. In this context, the plunger 14 behaves like a conventional pressure-regulating valve.

If the slide 4 is displaced and if the LS pressure int he cavity 15 makes it possible (i.e. if the LS pressure is less than the maximum pressure in the chamber 12), then the pressure int he chamber 12 becomes such that the plunger 14 is raised to its maximum, thereby maximally disengaging the inlet to the duct 21, while the channel 19 of the plunger opens out into the cavity 15. Fluid then flows from the passage 12 via the channels 18 and 19 into the cavity 15, and thence into the channel 8: the valve in question thus uses the LS pressure as its control pressure. Int his context, the plunger 14 behaves like a selector for selecting the maximum pressure in the LS control lien of the pump.

The advantage of the valve implemented in accordance with the invention stems simultaneously from the simplified structure (the same plunger serves both as a pressure compensator and as a pressure selector for the LS line, whereas in the past two distinct elements corresponding to two distinct hydraulic circuits have been used) and from the greater control accuracy that it provides for the pump: in prior art circuits, the LS pressure was taken from the load pressure or the working pressure proper (e.g. from the outlet orifices) with the drawbacks explained at the beginning of the present description, whereas in a valve organized in accordance with the invention, the LS lien is fed by the maximum pressure coming directly from the pump, and any leakage that may occur from the LS lien has no effect on the load (and in particular is no longer capable of causing the load to move down).

In addition, the slide is simple in design since it has no internal channels, so it is easy to manufacture and therefore less expensive.

Finally, the valve implemented in accordance with the invention makes it possible for the hydraulic circuit in which it is included to retain the advantage of operation by flow rate division that cannot be obtained by a load sensing system on its own, i.e. in a saturated circuit the velocities of all of the receivers are reduced in proportion to the respective flow rates through said receivers and as a result the most heavily loaded receiver is slowed down or stopped.

Figure 5:
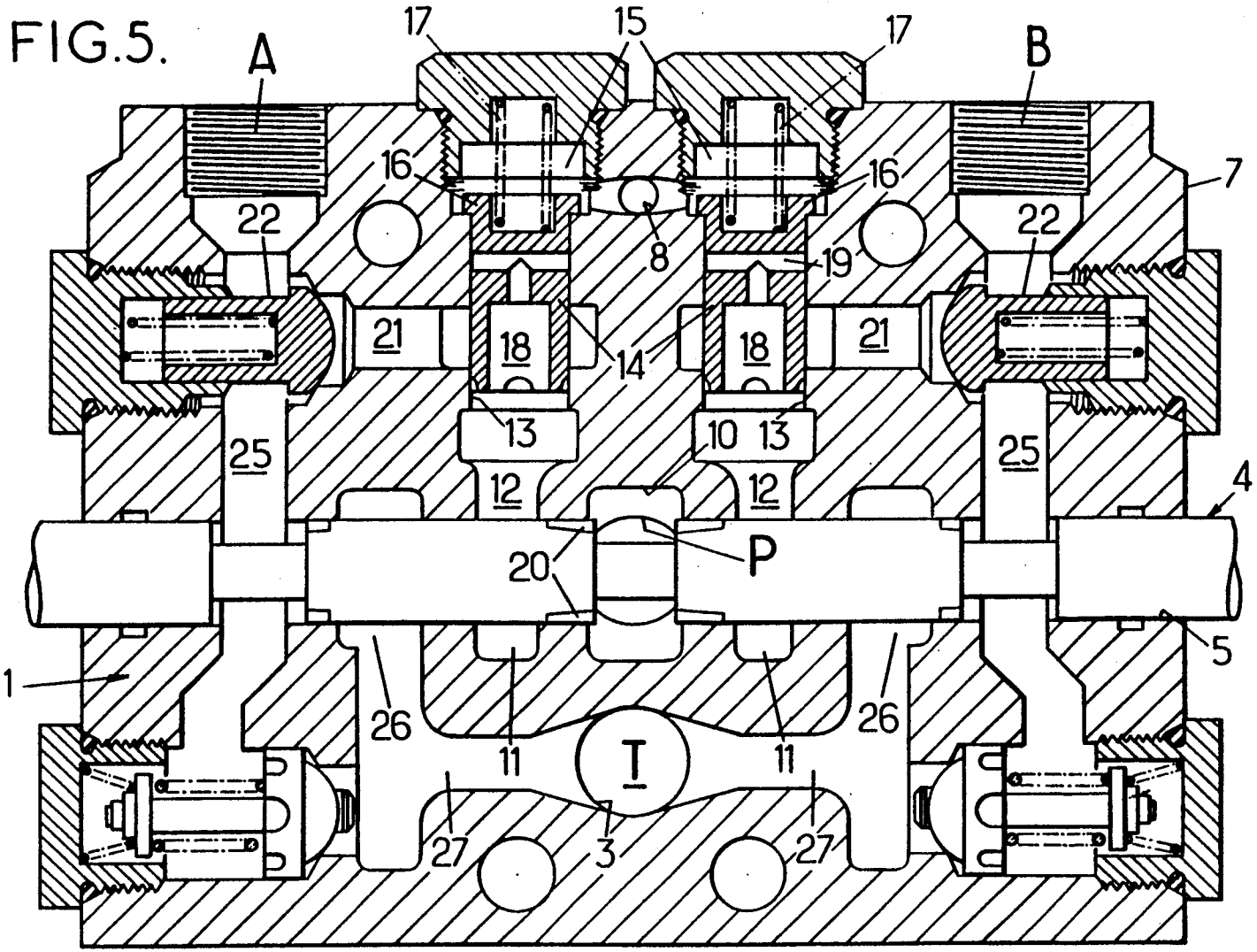
FIG. 5 is a section view through yet another variant hydraulic directional control valve implemented in accordance with the invention.

FIG. 5 shows a variant embodiment of the hydraulic directional control valve of the invention in which the pressure compensation circuit and the maximum pressure selection circuit is doubled-up in correspondence with each of the two outlet circuits A and B respectively. The same numerical references are used for designating times that are the same as int he valve of FIG. 1. The two cavities 15 are combined in a single LS channel 8. Operation remains identical to that described above except insofar as only one plunger comes into operation depending on the displacement direction of the slide 4 and depending on whether outlet is taking place via the orifice A or the orifice B.

Figure 6:
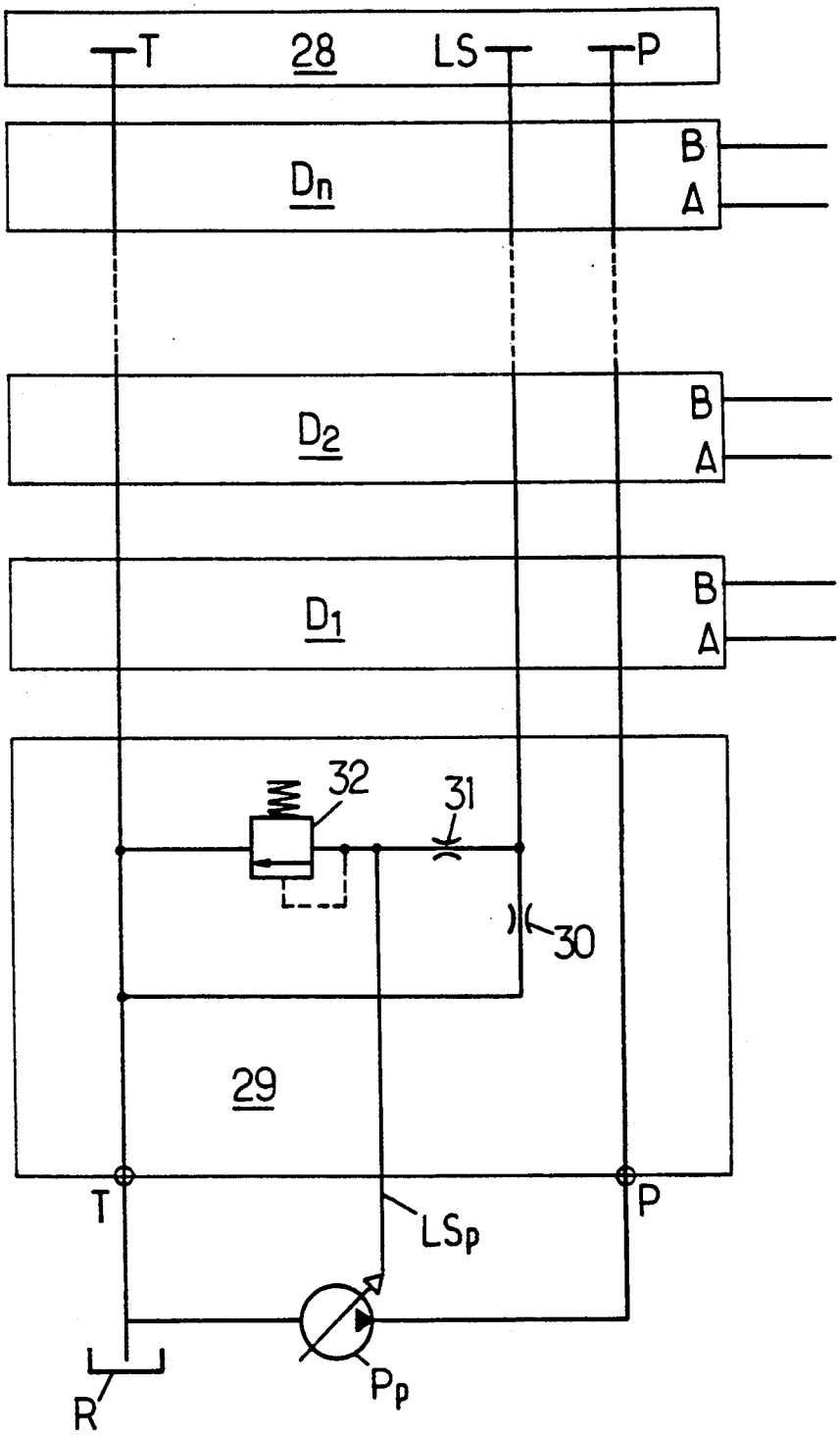
FIG. 6 is a circuit diagram showing one possible multiple hydraulic control circuit that includes directional control valves of the invention.

FIG. 6 is a circuit diagram showing an example of a multiple control hydraulic circuit that uses a multiple hydraulic control block constituted by a stack of a plurality of directional control valves of the invention.

The hydraulic control block comprises a stack of several valves $D_1, D_2, \ldots, D_n$, whose admission orifices P, return orifices T, and pump control orifices LS are all connected together, e.g. by mere fluid-tight juxtapositon of the main faces of the valve bodies, in a manner well known to the person skilled int he art. For example, a blind end element 28 may be mounted at one end of the stack so as to close the respective ducts P, T, and LS through the stack, with it being possible for said end element to be provided in certain applications with pressure-reducing means (not shown).

An inlet element 29 is transparent for the admission line P which is connected to the pressurized outlet of a variable flow rate source of pressurized fluid (which may be a variable flow rate pump $P_p$, for example, as shown in FIG. 6, or which may be a fixed flow rate pump having an open center valve), and for the return line T connected to a tank R.

In addition, the LS line is connected int he inlet element 29 to the return line T via a first flow rate regulator such as a constriction or nozzle 30 designed to enable the entire apparatus to be decompressed when the flow rate is zero (i.e. when all of the valves are in the neutral position).

Finally, the control pressure $LS_p$ that detects the load for connection to the pump is taken from the LS line upstream from the first construction 30 via a second constriction 31. The purpose of the constriction 31 is to re-establish a pressure drop across the terminals of the plunger 14 in each of the valves of the block. In the example under consideration, a single constriction 31 is placed in the inlet element 29. A pressure-limiting valve 32 for limiting the maximum value of the load sensing control pressure when the pump is operating at its maximum rate is interposed between the line $LS_p$ and the return line T.

Figure 7:
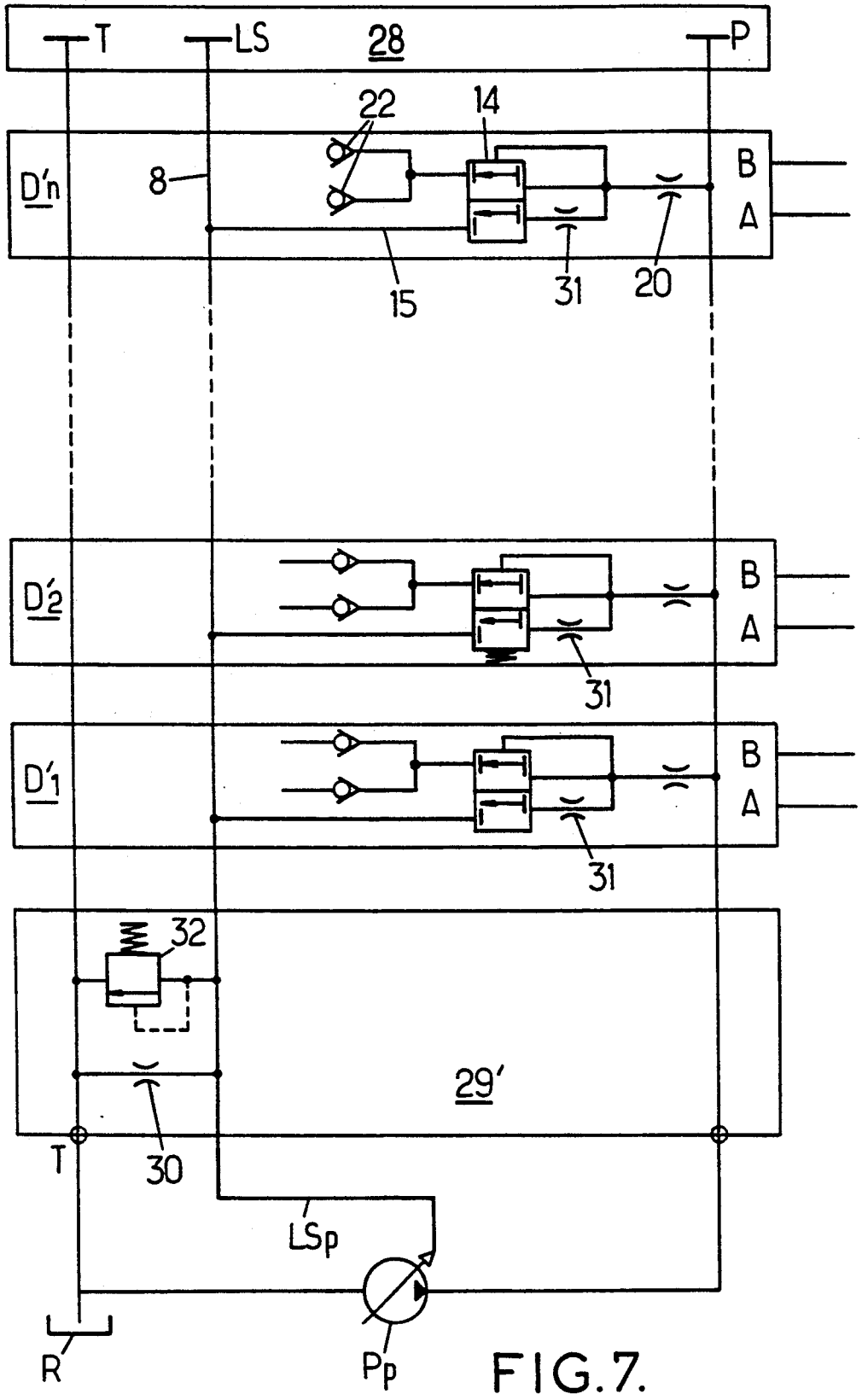
FIG. 7 is a diagram showing another possible multiple hydraulic control circuit that includes directional control valves of the invention.

FIG. 7 is a diagram showing another example of a multiple control hydraulic circuit using a multiple hydraulic control block made up of a stack of a plurality of directional control valves of the invention. This circuit differs from that of FIG. 6 in that a constriction 31 is now provided in each of the directional control valves, replacing the single constriction 31 previously housed in the inlet element 29.

In FIG. 7, the inlet element without the constriction 31 is given reference 29' whereas each of the directional control valves fitted with a respective constriction 31 are given respective references $D'_1, D'_2, \ldots, D'_n$. In each block $D'_1, D'_2, \ldots, D'_n$ the valve is shown in highly simplified form, together with the same numerical references as are used in FIG. 1, so as to show how the constriction 31 is situated. The constriction 31 is interposed between the load sensing line channel 8 and the distribution chamber 11. The constriction comes into operation when communication is established between the passage 12 and the channel 8 by displacement of the plunger 14, and it is designed to set up a head loss that is less than the rated value of the spring acting on the plunger in the corresponding valve.

Figure 8:
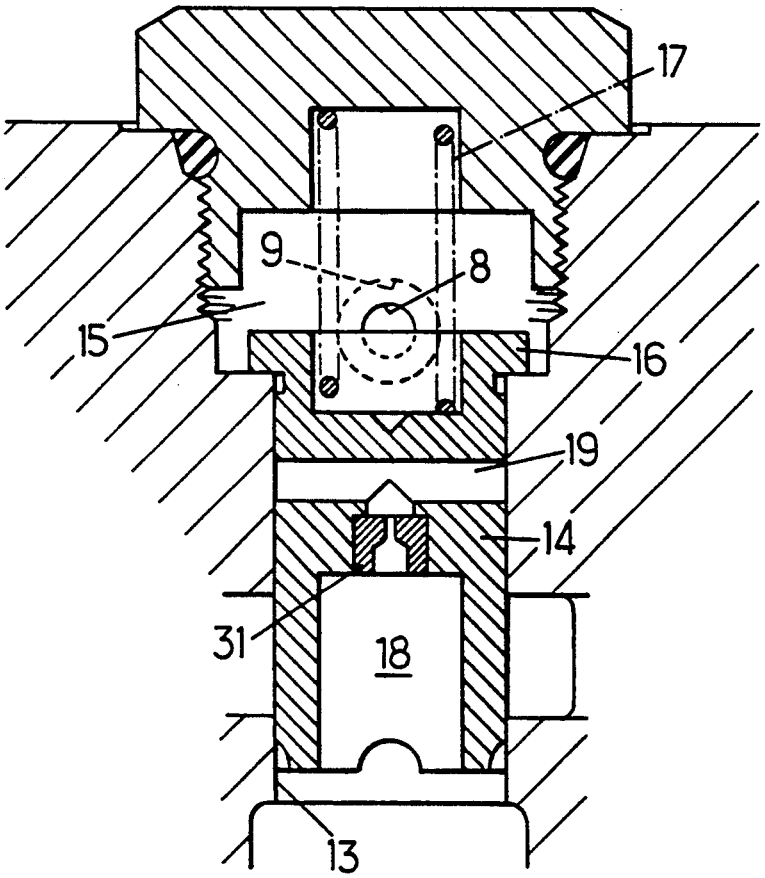
FIG. 8 is a view on a larger scale showing a portion of the valve organized for being incorporated in the circuit of FIG. 6.

FIG. 8 shows an example of how the constriction 31 may be installed. This view is on a larger scale showing the plunger 14 with the constriction 31 located in the narrow upper portion of the axial channel 18 that is formed in the plunger and that connects the passage 12 to the diametrically-extending channel 19 also formed in the plunger. It is thus easy and cheap to adapt the directional control valve to this type of circuit.

Naturally, and as can be seen from the above, the invention is not limited to the embodiments and applications described in detail. On the contrary, it extends to an variant.

I claim:

1. A pressure compensating hydraulic directional control valve comprising:

a valve body;

a slide received in the body to be capable of being displaced longitudinally therein for selectively transmitting a pressurized hydraulic fluid to working orifices provided in the body from an orifice for admitting pressurized hydraulic fluid;

a passage in said body for connecting a distribution chamber to the working orifices, the distribution chamber being associated with the slide and being suitable for being connected selectively to the admission orifice by the displaced slide;

a load sensing line channel combined with maximum pressure selecting means organized to establish in said channel the maximum pressure selected from the pressure existing in said channel and the pressure of the pressurized fluid of the valve; and pressure compensating means placed in said passage and responsive to the difference between the pressure of the fluid in the valve and the pressure existing in said channel in order to generate a substantially fixed pressure drop in the pressurized fluid flowing towards the working orifices;

wherein, in the valve, the pressure compensating means are combined with the maximum pressure selecting means;

and selective link means exist that are suitable for selectively establishing a link between the channel and the passage upstream from the pressure compensating means in such a manner that:

if the pressure in the channel is greater than or equal to the pressure of the fluid in the passage upstream from the pressure compensating means, no communication exists between said passage and said channel, and the pressure in the channel retains its value; or else if the pressure in the channel is less than the pressure of the fluid in the passage upstream from the pressure compensating means, communication is established between said passage upstream from the pressure compensating means and said channel, and the pressure in the channel becomes the same as the pressure of the fluid present in the passage upstream from the pressure compensating means.

2. A hydraulic valve according to claim 1, wherein the pressure compensating means combined with the maximum pressure selecting means comprise:

a bore provided in the body and connected at one end to said passage coming from the chamber controlled by the slide and at its other end to said load sensing line channel;

a moving control plunger free to slide in said bore under drive from the pressures acting on opposite ends thereof;

first shutter means disposed in said pressurized fluid passage and secured to said plunger; and second shutter means disposed in a connection between said pressurized fluid passage and said channel, and secured to said plunger, said plunger being suitable for occupying:

a first end position or "doubly-closed" position which it occupies in the absence of pressurized fluid, and in which the first and second shutter means are closed;

a set of intermediate positions occupied when the pressurized fluid is present in the passage, the position of the plunger being determined by the difference between the pressure in the passage and the pressure in the channel when the pressure in the channel is greater than the pressure in the passage, in which the second shutter means are kept closed and the first shutter means are opened to an extent suitable for causing a predetermined pressure drop in the flow of pressurized fluid; and a second extreme position or "doubly-open" position which is occupied when the pressure of the fluid in the passage is greater than the pressure in the channel, in which the first shutter means are fully open and the second shutter means are also open, thereby establishing communication between said passage and said channel.

3. A hydraulic valve according to claim 2, wherein:

the portion of said passage connected to the chamber controlled by the slide communicates with one end of the bore;

the portion of said passage connected to the working orifices opens radially into the bore; and said first shutter means are constituted by said plunger implemented in elongate form so that:

in its first stream position, it fully closes said opening of the passage;

in its set of intermediate positions, it partially closes said opening to create the predetermined pressure drop; and in its second extreme position it completely disengages said opening.

4. A hydraulic valve according to claim 3, wherein said second shutter means are constituted by said plunger provided with an internal duct that opens out at one end into the face of the plunger which is subjected to the pressure of the fluid int he passage and that opens out at its other end radially into the vicinity of the other face of the plunger which is subjected to the pressure of the channel, whereby:

when the plunger is in its first extreme position and in its set of intermediate positions the radial outlet of said duct is closed by the bore; and when the plunger is in its second extreme position, the radial outlet of said duct has moved out from the bore and is in communication with said channel.

5. A hydraulic valve according to claim 2, wherein the pressure compensating means combined with the maximum pressure selecting means further comprise resilient return means acting on the moving plunger to urge it in the same direction as the direction in which it is urged by the pressure that exists in the channel.

6. A hydraulic valve according to claim 1, wherein the combined pressure compensating means and maximum pressure selecting means are unique and are selectively connectable to one of the two working orifices.

7. A hydraulic valve according to claim 1, wherein the combined pressure compensating means and maximum pressure selecting means are two-fold, each associated with a respective one of the two working orifices.

8. A hydraulic valve according to claim 1, wherein at least one non-return valve is provided in the above-specified passage, between the pressure compensating means and at least one of the working orifices.

9. A hydraulic valve according to claim 8, including a single non-return valve in the above-specified passage, between the pressure compensating means and one of the working orifices.

10. A hydraulic valve according to claim 8, including two non-return valves in the above-specified passage, between the pressure compensating means and each of the two working orifices, respectively.

11. Multiple hydraulic control apparatus interposed between a variable flow rate source of pressurized fluid and a return tank on one side and a plurality of hydraulic load members capable of being respectively and selectively controlled from said source, the apparatus comprising a side-by-side stack of:

a plurality of hydraulic directional control valves according to claim 1;

a terminal element; and an inlet element which is transparent for the lines through the stacked valves and connected respectively to the pressurized outlet from the source and to the return tank, which includes a flow rate regulator for the purpose of decompression at zero flow rate interposed between a control line for controlling the source by sensing the load from the stacked valves and the return line, and which includes a constriction interposed between the control line for controlling the source by sensing the load from the stacked valves and the control input of the source, said constriction being disposed to establish a smaller head loss across the terminals of the plunger in each of the valves.

12. Multiple hydraulic remote control apparatus according to claim 11, wherein a pressure limiting circuit is interposed between the control inlet of the source and the return line, the pressure limiter limiting the load sensing source control pressure and being suitable for limiting said control pressure when the source is providing its maximum pressure.

13. Multiple hydraulic control apparatus interposed between a variable flow rate pressurized fluid source and a return tank on one side, and a plurality of hydraulic load members suitable for being respectively and selectively controlled from said source, the apparatus comprising a side-by-side stack of:

a plurality of hydraulic directional control valves according to claim 1, each valve including a constriction interposed between the load sensing line channel and the distribution chamber, said constriction being made operative when communication is established between the passage and the channel and being disposed to establish head loss across the terminals of the plunger of the valve;

a terminal element; and an inlet element which is transparent for the lines through the stacked valves connected respectively to the pressurized outlet from the source and to the return tank, and which includes a flow rate regulator providing decompression at zero flow rate, interposed between a control line for controlling the source by sensing the load from the stacked valves and the return line.

14. Multiple hydraulic remote control apparatus according to claim 13, wherein the constriction in each valve is received in the connection provided inside the plunger.

* * * * *